United States Patent [19]

Koszyk

[11] Patent Number: 4,624,806

[45] Date of Patent: Nov. 25, 1986

[54] COMPACT PORTABLE HUMIDIFIER

[76] Inventor: Kathleen Koszyk, 10 Meadowood La., Northfield, Ill. 60093

[21] Appl. No.: 766,519

[22] Filed: Aug. 19, 1985

Related U.S. Application Data

[63] Continuation-in-part of Ser. No. 709,773, Mar. 8, 1985, Pat. No. 4,540,529.

[51] Int. Cl.[4] ..... B01F 3/04

[52] U.S. Cl. ..... 261/91; 141/114; 261/24; 383/7; 383/33

[58] Field of Search ..... 261/24, 91, 80, 121 M, 261/74; 55/373-378; 141/314, 313, 114, 166, 391; 312/31.02; 220/74; 383/7, 17, 20, 33, 34

[56] References Cited

U.S. PATENT DOCUMENTS

| | | | |
|---|---|---|---|
| 1,451,343 | 4/1923 | Panagopolous | 383/7 X |
| 2,126,203 | 8/1938 | Miskella | 383/7 X |
| 3,052,269 | 9/1962 | Manas | 141/114 |
| 3,131,832 | 5/1964 | Strandberg et al. | 383/7 X |
| 3,290,021 | 12/1966 | Blachly et al. | 261/91 X |
| 3,348,821 | 10/1967 | Martin et al. | 261/91 X |
| 3,365,181 | 1/1968 | Schwaneke | 261/91 X |
| 3,376,025 | 4/1968 | Flury | 261/91 X |
| 3,640,464 | 2/1972 | Malczewski | 261/91 X |
| 3,806,984 | 4/1974 | Hilsabeck | 383/34 X |
| 3,864,437 | 2/1975 | Blaszkowski | 261/24 |
| 3,893,649 | 7/1975 | Cornell et al. | 383/33 X |
| 4,018,004 | 4/1977 | Soffer | 261/91 X |
| 4,099,598 | 7/1978 | Clinard | 141/313 X |
| 4,286,636 | 9/1981 | Credle | 141/114 |
| 4,540,529 | 9/1985 | Koszyk | 261/91 |
| 4,550,440 | 10/1985 | Rico | 383/33 |

FOREIGN PATENT DOCUMENTS

| | | | |
|---|---|---|---|
| 537769 | 7/1941 | United Kingdom | 383/33 |

*Primary Examiner*—Richard L. Chiesa

*Attorney, Agent, or Firm*—Cook, Wetzel & Egan, Ltd.

[57] ABSTRACT

A portable electric humidifier uses a flexible, disposable bag as a container for water, to provide a compact, collapsible, and easily portable system. A humidifier head contains a motor and an air humidifying apparatus such as a spinning disk and conical shaft. The head is supported on folding legs. The flexible bag is supported by and hangs beneath the humidifier head. The conical shaft extends downwardly from the spinning disk and draws water from the bag and conveys it to the disk, from which it is dispersed in an air stream into a room. The shaft in one embodiment telescopes, to occupy a minimum vertical distance for storage within the height of the folded legs, and in another embodiment is removable for storage. The flexible bag container is inexpensive and may be discarded after use at one location, prior to packing for further travel. Thus, the humidifier provides overnight humidification for a hotel room or the like, while being conveniently packable for transportation in any small suitcase.

8 Claims, 10 Drawing Figures

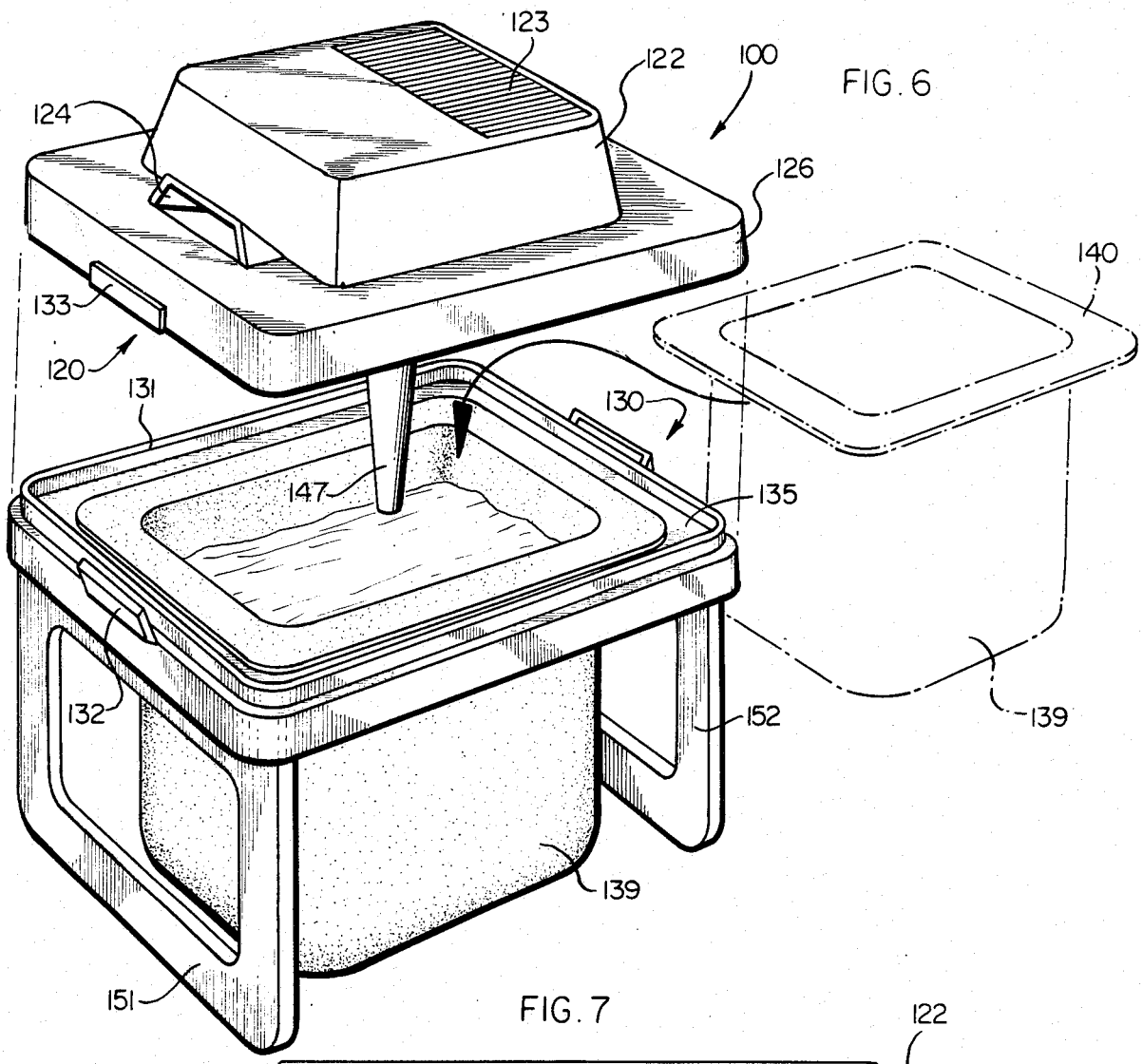
FIG. 6
FIG. 7
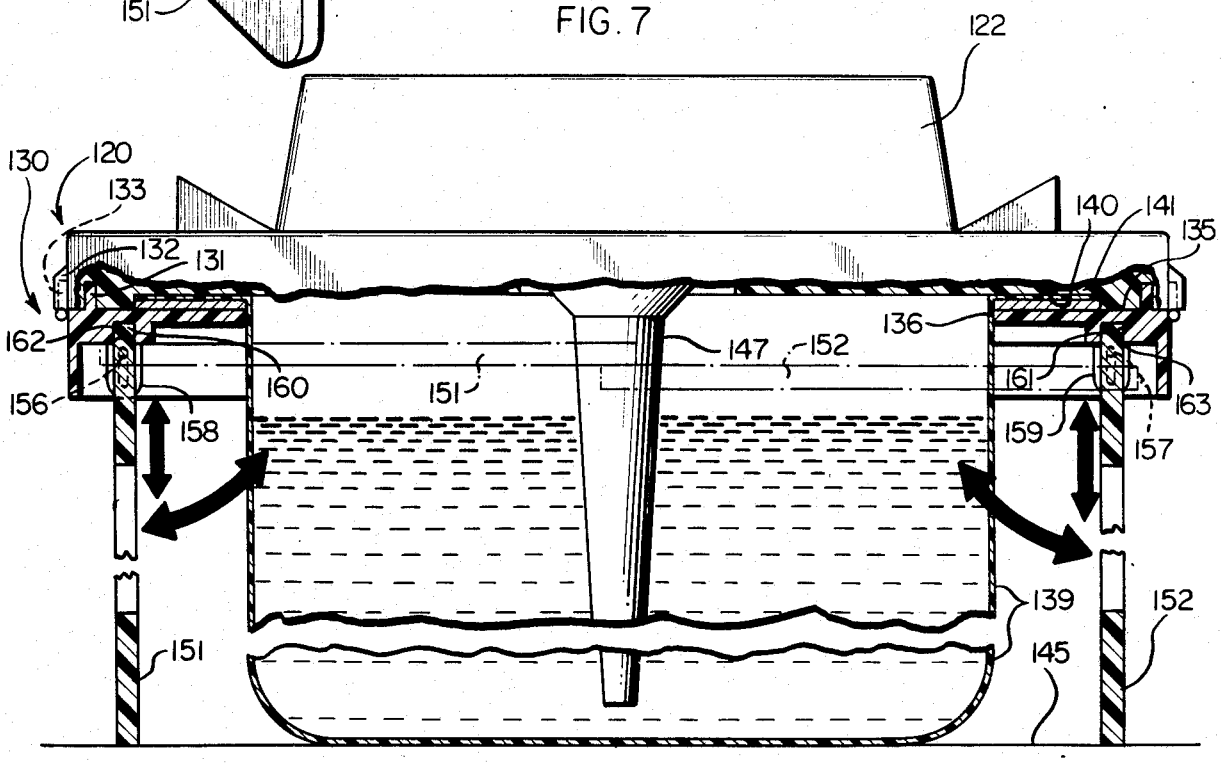

COMPACT PORTABLE HUMIDIFIER

This disclosure is a continuation-in-part of my copending application Ser. No. 709,773, filed Mar. 8, 1985, and issued on Sept. 10, 1985 as U.S. Pat. No. 4,540,529.

The present invention relates to humidifying apparatus, particularly to domestic and portable room humidifying apparatus.

Prior art room humidifiers have not been conveniently portable for use by travellers because they invariably have incorporated a rigid or semi-rigid reservoir integrally with the humidification system. No disposable container is known for use with room humidifiers. A traveller thus has had to carry either a bulkly device, or a very small humidifier which has to be frequently refilled, or do without supplemental air humidification beyond that provided by hotel, motel, ship and railroad accommodations. Lack of adequate humidity can be annoying and unhealthful.

In accordance with the principles of the present invention, a compact and portable humidifier comprises a power head, a flexible, disposable bag connected to or carried on the head for holding a sufficient quantity of water for overnight room air humidification, and support legs connected to the humidifier head for supporting same during operation. The bag and legs fold or collapse to a compact form for storage in a traveller's suitcase. The supporting legs in one embodiment are carried outside the bag, pivoted together and being captured at their upper end in slots in the humidifier head, for sliding movement between erected, inward positions and collapsed outward positions. The support legs in another embodiment fold underneath the head. The legs may have base portions underlying the flexible bag, to help support the bag while the humidifier, filled with water, is being transported within a room. A vertical water pick-up shaft is made to telescope within the bag, or is fixed in length and is removable for convenient storage and set up. The bag is disposable, for easy packing and travel.

In the drawings,

FIG. 6 is an exploded perspective view of a second embodiment of a portable humidifier of the invention;

FIG. 7 is a longitudinal view, with the lower portion broken away in section, with the legs shown in their alternate positions;

Figure 1:
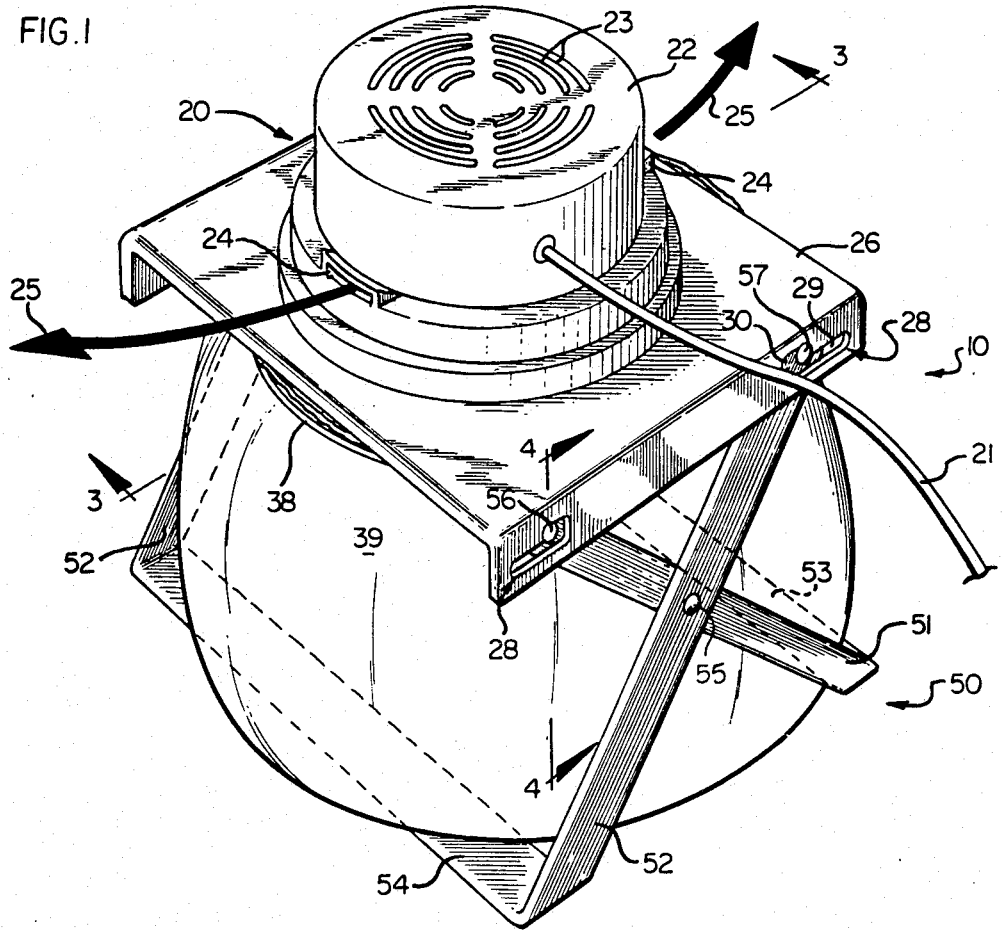
FIG. 1 is a general perspective view of a portable humidifier of one embodiment of the invention, set up for operation.

A portable, compact humidifier in accordance with one embodiment of the present invention is shown at 10 in FIG. 1. A power head is supplied with electric power through a line cord 21 and has a hollow plastic housing 22 for mounting a small, vertical-shaft electric motor M therein. A plurality of vents 23 formed in the top of the housing 22 provide air to cool the motor. The air passes into the head for humidification. Air outlets 24 are provided in the housing 22 for release of the humidified air, depicted by the arrows 25, into the room.

The humidifier head 20 further comprises a top plate 26 which carries the motor housing 22. A water inlet port is provided through the top plate 26, in a position away from the power cord and not shown in the drawings. The top plate 26 terminates at its ends in downturned lips 27, each of which contain a pair of "J"-shaped slots 28. These slots 28 have lower, elongated horizontal portions 29, inward vertical portions 30, and upper catch portions 31, as better shown in FIG. 2.

Figure 3:
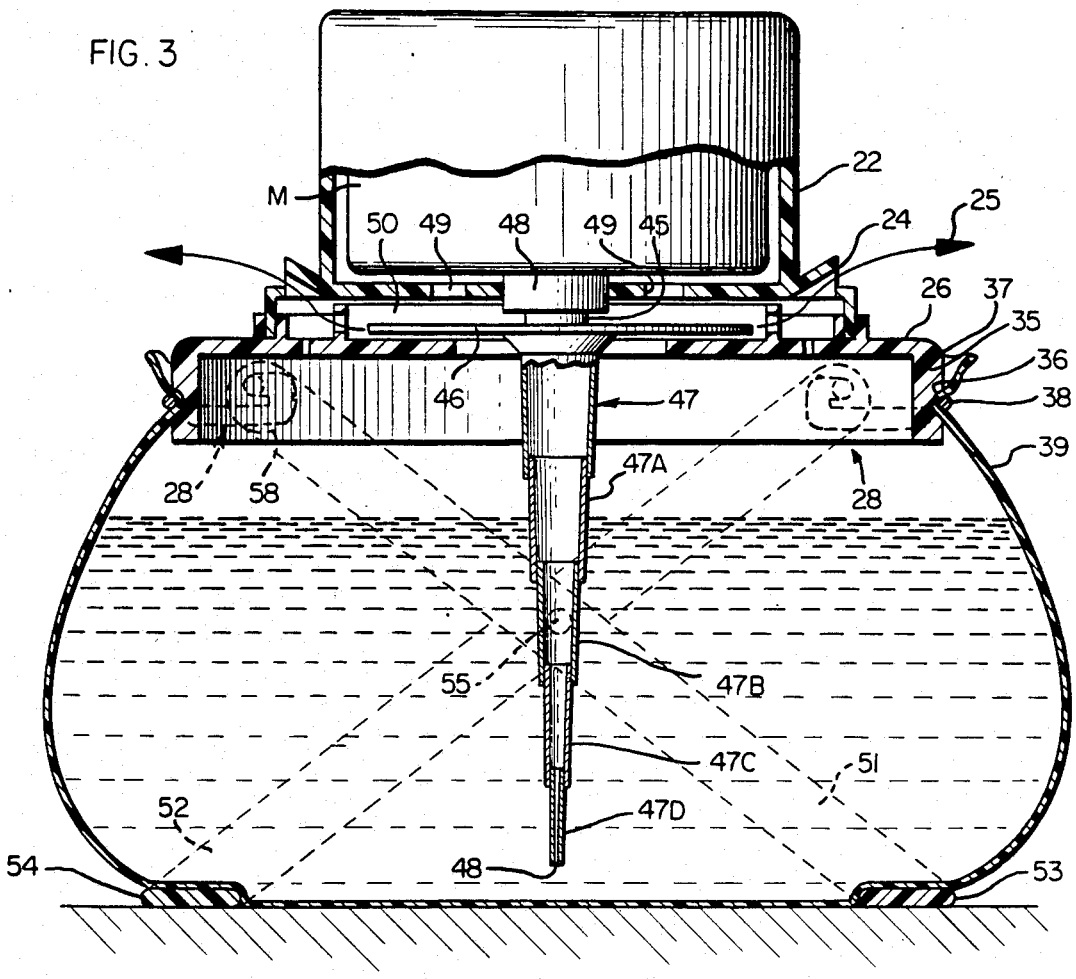
FIG. 3 is a view taken on plane 3—3 of FIG. 1, partly in section through the humidifier, and showing the internal components thereof.
Figure 4:
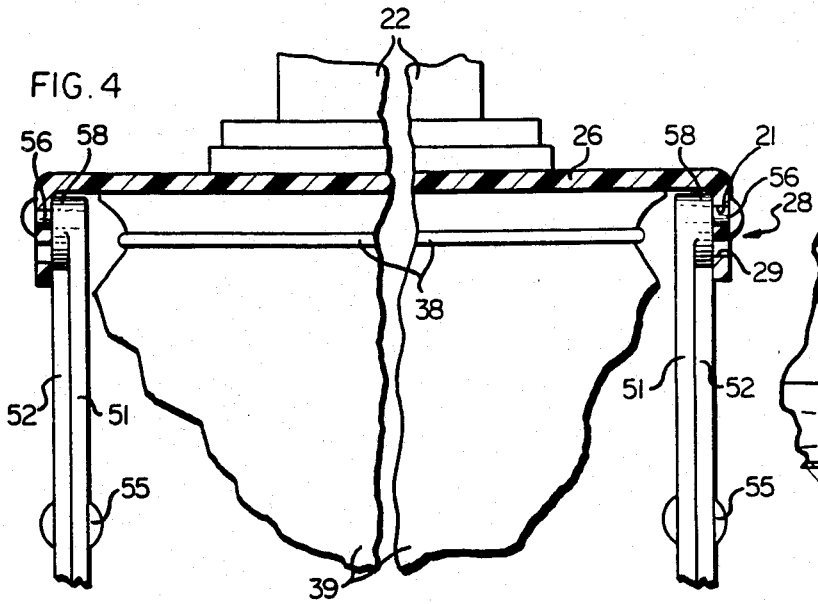
FIG. 4 is a longitudinal sectional view, taken on plane 4—4 of FIG. 1, and partly broken away.

As shown in FIG. 3, a downwardly depending skirt 35 is formed on the undersurface of the top plate 26. An annular recess 36 is formed in an outer surface 37 of the skirt 35. A crimping member 38, which is an elastic band or a spring steel band such as a hose clamp, holds securely a disposable, flexible water reservoir bag 39 suspended downwardly from the skirt 35. The outer surface 37 of the skirt 35 is shown as cylindrical in shape, but it may alternatively be generally rectangular or of other convenient shape, depending on the desired design appearance of the humidifier 10.

The bag 39 is of tough but light and flexible material such as reinforced, waterproofed nylon sheeting, or 2 to 6 mil polyvinyl chloride plastic sheeting. It may be of inexpensive material and configuration and be disposable after use at one location. Disposability avoids the problems of packing a wet container into a suitcase.

A vertically extending shaft 45 of the motor contained within the housing 22 carries integrally therewith a disk 46 which carries on its under surface a downwardly extending water drawing shaft 47. The motor shaft 45 is journaled in a bearing 48 mounted in the motor housing 22. Air slots 49 exhaust air drawn into the slots 23 in the top of the housing 22 into a water misting chamber 50 which contains the spinning disk 46.

Figure 5:
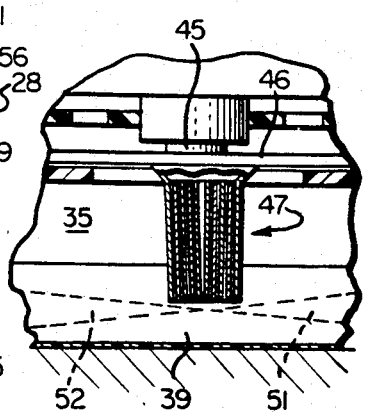
FIG. 5 is a sectional view taken on the plane of FIG. 3 but with the bag, legs, and shaft collapsed.

The water draing shaft 47 is an inverted cone. In accordance with one facet of the invention, it is formed as a plurality of telescoping sections 47A, 47B, 47C, and 47D. The upper portion of the shaft 47 is carried directly on and in communication with the surface of disk 46, and the lower portions A through D when unsupported fall of their own weight to the position shown in FIG. 3. Inner surfaces of the upper portions engage frictionally with the outer surface of each next lower section in the extended position, to insure that the sections are co-axial and that they spin together. The sections at the same time easily collapse to the position shown in FIG. 5 upon collapsing of the supporting legs, as described below. A lowermost end 48 of the shaft 47 is rounded so as to reduce risk of puncture to the bag 39.

Alternatively, rather than being telescopic, the shaft 47 can be made as a single member of a proper length, with a releasable press-fitting between an upper portion of the shaft 47 and the disk 46 or motor shaft 45 for co-axial alignment and positive attachment. Such a removable shaft is easily manipulated through the flexible bag 39 if desired, being attached for use prior to filling the bag 39 with water and being detached by pulling it from the press-fit connection upon completion of use.

Alternatively, the crimping member 38 can be detached from the skirt 35 and the shaft manipulated directly, particularly where the bag 39 is disposable and is removed for packing.

The power head 20 of the humidifier 10 is supported a selected distance above a horizontal surface such as a table top (with the flexible gag 39 supported from and below the head 20) by two pairs of collapsible legs 50, comprising an inward pair of legs 51 and an outward pair 52. In this first embodiment shown, the legs of each pair are joined together at their bottoms by longitudinal members 53, 54, which lie directly upon the table top and support and strengthen the lower ends of each pair of legs 51, 52. Each pair of legs 51, 52 is pivoted together at their juncture at a pin 55. Upper ends of the legs 51, 52 carry further pins 56, 57, which are captured in the slots 28 formed in the downturned lips 27 of the top plate 26 of the humidifier at 20. The upper ends of the inner legs 51 are formed with spacer disks 58 which have the thickness of the outer legs 52, to avoid manufacturing complexity while assuring smooth operation of the legs 51 and 52 in their folding and unfolding action.

Figure 2:
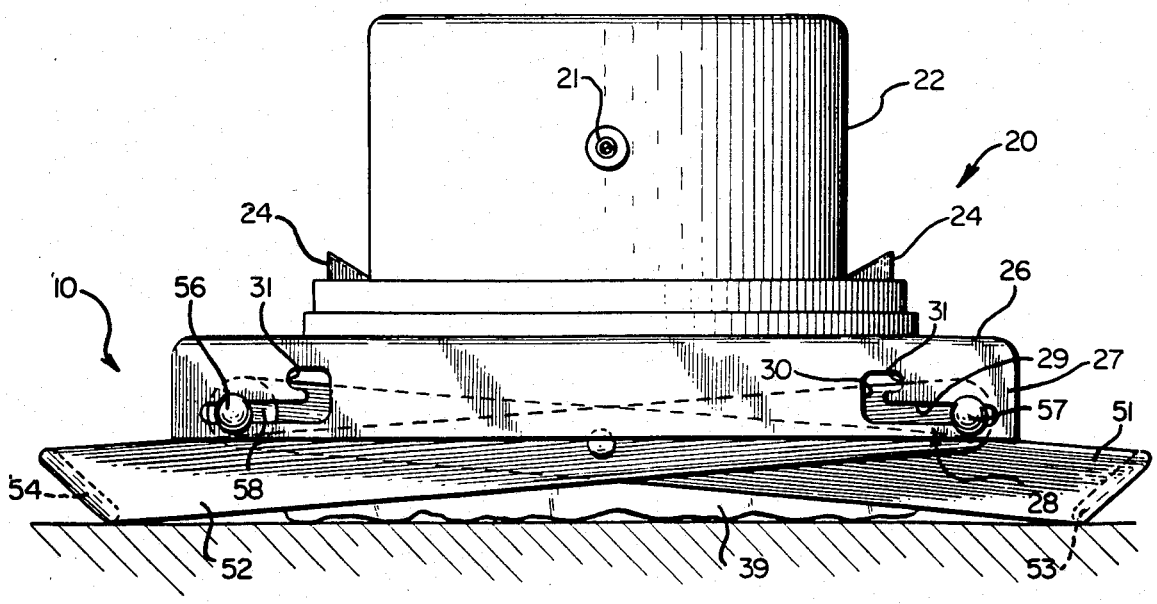
FIG. 2 is an end elevation view of the portable humidifier with its legs, a bag, and the shaft collapsed for packing and transportation.

In use, the humidifier 10 is unpacked from a traveller's suitcase in the configuration shown in FIG. 2. The legs 51 and 52 are unfolded downwardly, with the captured pins 56 and 57 moving inwardly in the lower horizontal slots 29 to the inward edge of the vertical slot 30, and then up and into the capture slots 31. In that position the legs 51, 52 are locked into the fully downward position shown in FIG. 1. The shaft 47 is placed into position, either of its own weight or by manual manipulation, either directly or through the bag 39 if that is in place already. Where the telescoping shaft shown in FIG. 3 is used, it is a good idea to grasp the lowermost section 47D and pull it gently downwardly, to insure that the sections are fully extended and straight. The bag 39 is attached to the skirt 35 if not in place already, by placing its open end around the outer surface 37 and securing the crimping member 38 about it and into the annular notch 36. Then the bag 39 is filled with water through the filling port (not shown) in the top plate 26, and the humidifier 10 is placed on a table top surface for use. The flat base portions 53, 54 of the legs 51, 52 help support the weight of the bag and water during carrying from a sink to the tabletop. Alternatively, the bag 39 of course can be filled by pouring water from another container at the location of use.

When the line cord 21 is plugged into a wall outlet, and any line switch (not shown) is closed, motor shaft 45 spins the disk 46 and the water drawing shaft 47. Air is drawn through the slots 23 and through the motor casing 22 by the centrifugal action of disk 46, forcing air from the misting chamber inlet slots 49 through the outlet apertures 24 in streams 25. Water is drawn from the flexible bag 39 up the interior walls of the shaft 47 and onto the disk 46. Spinning of the disk breaks the water film into fine droplets as they leave the outward edge of the disk 46, where the droplets join the stream of air 25, thus enriching the stream of air 25 with moisture. About five pints of water within the bag 39 will humidify a heated hotel room adequately for a 7 to 9 hour period.

When the humidifier 10 is to be packed for travel, the bag 39 is removed and may be discarded. It can alternatively be emptied either through the filling spout or by detaching the crimping band 38 from the skirt 35 and pouring remaining water from one side of the bag 39, and the bag retained for reuse. The legs 51 and 52 are folded back to their collapsed positions by moving the pins 56 and 57 in the slot members 28, and the shaft 47 is telescopically collapsed or is removed and placed to one side within bag 39.

A second embodiment of the invention of the present application as shown in FIGS. 6 and 7. This embodiment offers certain simplifications and a distinctly different design over that shown in FIGS. 1 through 5. The portable, compact humidifier in accordance with this embodiment is shown at 100 in FIG. 6. A power head 120 has a hollow plastic housing 122 for mounting a small, vertical-shaft electric motor therein. A plurality of air vents 123 formed in the top of that housing 122 provide air to cool the motor. The air further passes into the head and is there humidified. Air outlets 124 are provided in the housing 122 for release of the humidified air into the room. Internal portions of the power head 120 in this embodiment, as to the operation of the water intake shaft 147 and the associated water misting chamber, disk, and other portions are similar to those of the first embodiment, above.

In this embodiment, the power head 120 comprises also a base 130. A flange 131 upstanding about a rim of the base 130 matches the top and base portions together. A firm connection is secured by a hinged clamp 132 engaging a fixed protrusion 133 on the lower and upper portions, respectively. The base 130 has a flat upper surface 135 inwardly of the flange 131 and extending to an inward edge 136. A flexible, disposable plastic bag 139 is received within the opening formed by the flange 136. In accordance with principles of the invention, the upper, open end of the bag 139 is formed with a relatively stiff collar 140 which lies atop the surface 135 when the bag 139 is inserted through the aperture in the bse 130. As shown in FIG. 7, an outer periphery of the collar 140 is captured and held by a molded portion 141 of the power head 120, when the upper and lower portions 120, 130, are placed together and fastened with the clamps 132, 133. Also in accordance with the invention, the bag collar 140 is stiff enough that the flexible bag 139, filled with water as shown in FIG. 6, can be carried from a sink to a countertop in the base 130 without danger of its collapsing through the aperture and flange 136.

The humidifier head 120 is supported on the base 130 a distance above a table or countertop 14 sufficient to provide a volume of water in the bag 139 for overnight humidification of a typical hotel room. Such support is provided in this embodiment by foldable legs 151, 152 fitted to either end of the base 130. As shown in FIG. 7, each of the legs 151, 152 is retained to the base 130 by pairs of pins 156, 157 at either end thereof. The pins slide in slots formed in brackets 158, 159 connected to the base 130, for instance on an inward side of a downwardly depending skirt surrounding the lower part of the base 130. As shown in FIG. 7, an upper portion 160, 161 of each of the legs 151, 152 is captured in its upright position by a rectangular cut-out 162, 163 on the underside of the base 130. The cut-outs 162, 163 provide added stiffness to the legs 151, 152.

For folding the legs 151, 152, the base 130 is lifted from the countertop 145 and the legs are pulled vertically downwardly, so that the pins 156, 157 move to the bottoms of the slots in their respective brackets 158, 159. The water uptake shaft 147 is removed and stored, and the legs 151, 152 are pivoted on the pins 156, 157, to their storage positions, shown in phantom in FIG. 7.

The emptied bag 139 has been previously removed and discarded or collapsed for packing.

Figure 8:
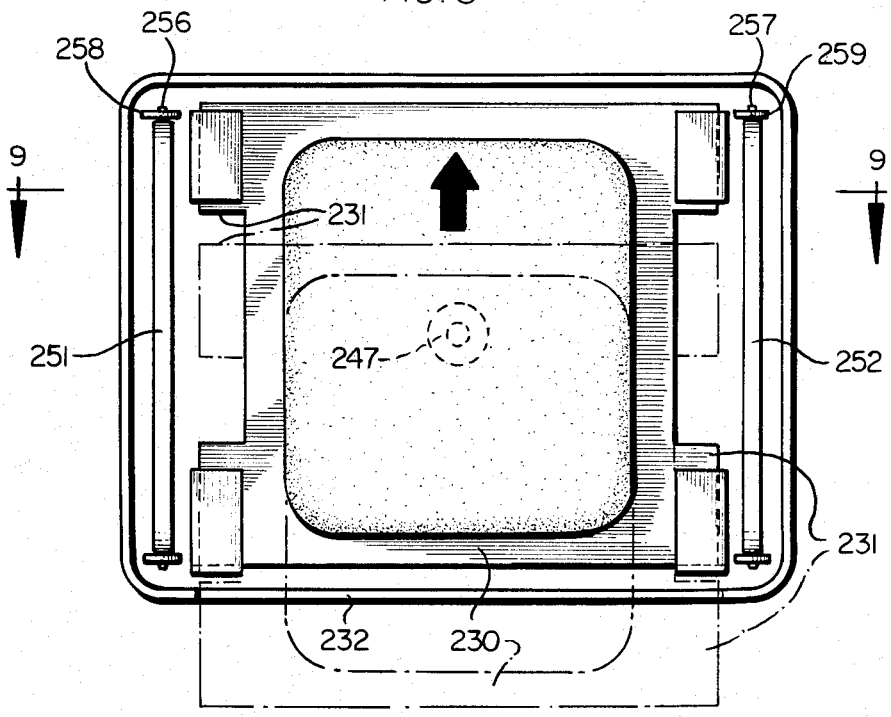
FIG. 8 is a bottom, plan view of a portable humidifier of a third embodiment of the invention, showing the bag holder in alternate positions.
Figure 9:
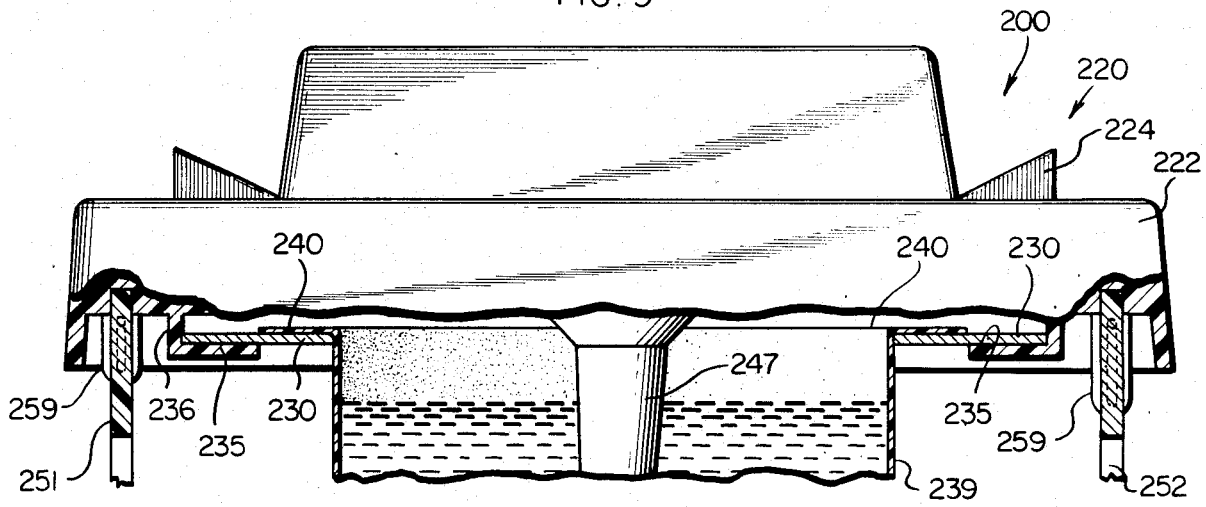
FIG. 9 is a longitudinal view, partly broken away in section, taken on line 9—9 of FIG. 8.
Figure 10:
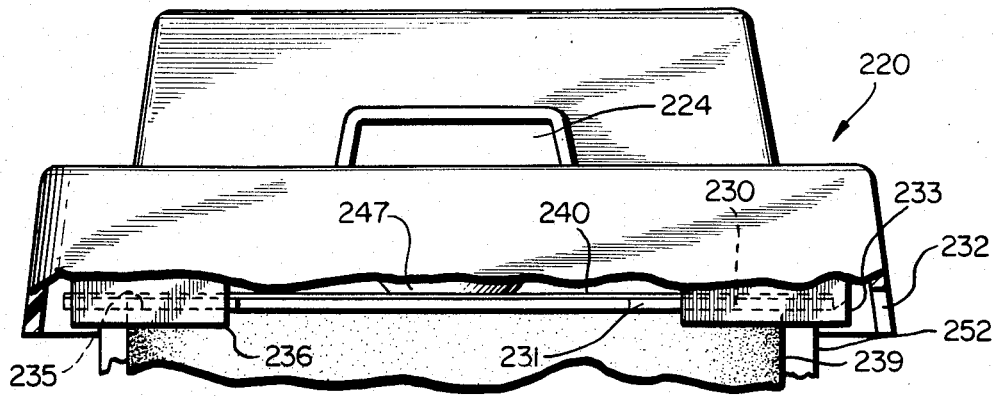
FIG. 10 is an end view, partly broken away, of the embodiment of FIG. 8.

A third embodiment of the invention is shown in FIGS. 8 through 10. In this embodiment, the portable, compact humidifier is shown at 200 in FIG. 9. The power head 220 has a hollow plastic housing 222 with a plurality of intake air vents and a pair of air outlets 224.

In accordance with the principles of the invention with respect to this embodiment, the humidifier head 220 is provided in a single piece, with a flexible bag 239 carried upon and located within the head 220 by a flat bag holder plate 230, best shown in plane view in FIG. 8. In this embodiment, a rigid collar 240 formed around the open, upper edge of the flexible bag 239 as in the second embodiment is received upon a bag holder plate 230. Plate 230 supports the entire surface of the bag collar 240 and also engages support surfaces 235 carried in the head 220 on downwardly depending brackets 236. Lug portions 231 of the bag holder plate engage the surfaces 235 and, by their positioning relative to the support surfaces 235 along the length of the rectangular bag 239, allow insertion of the bag holder 230 and bag 239 onto the support surfaces 235 under the motor housing 220 despite the downward protrusion of the water drawing spike 247. A cut-out 232 in the skirt of the head, as shown in FIG. 10, permits the bag holder plate 230 to slide from the phantom position in FIG. 8 to the use position. A small lip 233 on each of the two support surfaces 235 adjacent the cut-out 232 and the motor housing skirt helps prevent the bag holder 230 from slipping from its use position.

Legs 251 and 252 are supported on brackets 258, 259, similar to those described in connection with the second embodiment. The tops of the legs 251, 252 are also engaged, in the use position by slots formed in the underside of the top of the head 220.

Various minor modifications to the embodiments shown and described will readily occur to one having skill in the humidifier design art, without departing from the principles of this invention. The invention is defined and limited only by the scope of the appended claims, and not by any particulars of any of the embodiments disclosed herein.

I claim as my invention:

1. An improved portable humidifier for use on a horizontal surface, the humidifier comprising:

a compact humidifier head including means for generating a stream of air and for enriching the water content of said stream of air and a horizontally-extending annular support surface formed about and spaced from said means;

a flexible bag carried by said humidifier head and adapted to hold water in communication with said means for enriching the water content of said stream of air;

the flexible bag having an upper opening and a relatively stiff, generally flat collar means extending outwardly from said upper opening for engagement with and support by said support surface of said humidifier head; and support legs connected to said humidifier head, said legs being foldable to a first position to lie immediately below the head and extendible to a second position to support the head a fixed distance above said surface, whereby the flexible bag holds sufficient water when said legs are in their second position for distribution into a room over a desired time to achieve effective room humidification.

2. The portable humidifier defined in claim 1, wherein the flexible bag is disposable and is adapted to be discarded and replaced with a fresh bag after use.

3. The portable humidifier defined in claim 1, wherein the bag and its collar means are generally rectangular in top plan form.

4. The portable humidifier defined in claim 1, wherein each of the support legs is comprised of one generally flat member pivotably connected to the head for positioning in a first, use position extending vertically downwardly from said head and supporting the head above said horizontal surface, and in a second, storage and travel position located closely under the head.

5. An improved portable humidifier for use on a horizontal surface, the humidifier comprising:

a compact humidifier head including means for generating a stream of air and for enriching the water content of said stream of air;

a flexible bag carried by said humidifier head and adapted to hold water in communication with said means for enriching the water content of said stream of air;

the flexible bag having an upper opening and a relatively stiff, generally flat collar means about said upper opening for engagement with and support by said humidifier head; and support legs connected to said humidifier head, said legs being foldable to a first position to lie immediately below the head and extendible to a second position to support the head a fixed distance above said surface, whereby the flexible bag holds sufficient water when said legs are in their second position for distribution into a room over a desired time to achieve effective room humidification and wherein the compact humidifier head further comprises top and bottom portions which interfit together with one another, the support legs being connected to said bottom portion and said bottom portion having a horizontal bag support surface thereon extending between said support legs, and wherein the flexible bag collar means is receivable upon said bag support surface for use.

6. The portable humidifier defined in claim 5, further comprising clamp means for removably connecting the top and bottom portions of the head together for use and for releasing the top and bottom portions for separation for filling and removal and placement of the flexible bag.

7. An improved portable humidifier for use on a horizontal surface, the humidifier comprising:

a compact humidifier head including means for generating a stream of air and for enriching the water content of said stream of air;

a flexible bag carried by said humidifier head and adapted to hold water in communication with said means for enriching the water content of said stream of air;

the flexible bag having an upper opening and a relatively stiff, generally flat collar means about said upper opening for engagement with and support by said humidifier head; and support legs connected to said humidifier head, said legs being foldable to a first position to lie immediately below the head and extendible to a second position to support the head a fixed distance above said surface, whereby the flexible bag holds sufficient water when said legs are in their second position for distribution into a room over a desired time to achieve effective room humidification and wherein the compact head comprises at least three downwardly depending and sidewardly extending lugs and a removable bag holder plate, the bag holder plate having surfaces forming a central aperture for receiving said flexible bag and lugs adapted to engage the support lugs in the head.

8. The portable humidifier defined in claim 7, wherein the lugs on the head are four in number and extend sidewardly toward one another beneath the head and wherein the lugs on the bag holder plate extend outwardly to positions engageable by the lugs on the head.

* * * * *